US007269549B2

(12) United States Patent
Jensen et al.

(10) Patent No.: US 7,269,549 B2
(45) Date of Patent: Sep. 11, 2007

(54) FREQUENCY-DIFFERENTIAL ENCODING A SINUSOIDAL MODEL PARAMETERS

(75) Inventors: Jesper Jensen, Delft (NL); Richard Heusdens, Alkmaar (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 905 days.

(21) Appl. No.: 10/270,948

(22) Filed: Oct. 15, 2002

(65) Prior Publication Data

US 2004/0204936 A1 Oct. 14, 2004

(30) Foreign Application Priority Data

Oct. 19, 2001 (EP) ..... 01203934
Jul. 15, 2002 (EP) ..... 02077844

(51) Int. Cl.
*G10L 19/00* (2006.01)

(52) U.S. Cl. ..... 704/203

(58) Field of Classification Search ..... 704/203
See application file for complete search history.

*Primary Examiner*—Susan McFadden

(57) ABSTRACT

An encoding method is characterised by a step of encoding parameters of a given sinusoidal component in encoded frames either differentially relative to other components in the same frame or directly, i.e. without differential encoding. Whether the encoding is differential or direct is decided algorithmically. A first type of algorithm produces an optimal result using a method derived from graph theory. An alternative algorithm, which is less computing intensive, provides an approximate result by an iterative greedy search algorithm.

22 Claims, 7 Drawing Sheets

Example:

-Assume: $\hat{a}_i = 10$ and $a_j = 11.8$

-Direct: $\hat{a}_j = 12$

-Diff.: $\Delta a_{ij} = 1.8$; $\Delta \hat{a}_{ij} = \cancel{12}\ 2$ $\hat{a}_j = \hat{a}_i + \Delta \hat{a}_{ij} = 12$

FREQUENCY-DIFFERENTIAL ENCODING A SINUSOIDAL MODEL PARAMETERS

This invention relates to a frequency-differential encoding of sinusoidal model parameters.

In recent years, model based approaches for low bit-rate audio compression have gained increased interest. Typically, these parametric schemes decompose the audio waveform into various co-existing signal parts, e.g., a sinusoidal part, a noise-like part, and/or a transient part. Subsequently, model parameters describing each signal part are quantized, encoded, and transmitted to a decoder, where the quantized signal parts are synthesised and summed to form a reconstructed signal. Often, the sinusoidal part of the audio signal is represented using a sinusoidal model specified by amplitude, frequency, and possibly phase parameters. For most audio signals, the sinusoidal signal part is perceptually more important than the noise and transient parts, and consequently, a relatively large amount of the total bit budget is assigned for representing the sinusoidal model parameters. For example, in a known scalable audio coder described by T. S. Verma and T. H. Y. Meng in "A 6 kbps to 85 kbps scalable audio coder" *Proc. IEEE Inst. Conf. Acoust., Speech Signal Processing*, Pages 877-880, 2000, more than 70% of the available bits are used for representing sinusoidal parameters.

Usually, in order to reduce the bit rate needed for the sinusoidal model, inter-frame correlation between sinusoidal parameters is exploited using time-differential (TD) encoding schemes. Sinusoidal components in a current signal frame are associated with quantized components in the previous frame (thus forming 'tonal tracks' in the time-frequency plane), and the parameter differences are quantized and encoded. Components in the current frame that cannot be linked to past components are considered as start-ups of new tracks and are usually encoded directly, with no differential encoding. While efficient for reducing the bit rate in stationary signal regions, TD encoding is less efficient in regions with abrupt signal changes, since relatively few components can be associated with tonal tracks, and, consequently, a large number of components are encoded directly. Furthermore, to be able to reconstruct a signal from the differential parameters at the decoder, TD encoding is critically dependent on the assumption that the parameters of the previous frame have arrived unharmed. With some transmission channels, e.g. lossy packet networks like the Internet, this assumption may not be valid. Thus, in some cases an alternative to TD encoding is desirable.

One such alternative is frequency-differential (FD) encoding, where intra-frame correlation between sinusoidal components is exploited. In FD encoding, differences between parameters belonging to the same signal frame are quantized and encoded, thus eliminating the dependence on parameters from previous frames. FD encoding is well-known in sinusoidal based speech coding, and has recently been used for audio coding as well. Typically, sinusoidal components within a frame are quantized and encoded in increasing frequency order; first, the component with lowest frequency is encoded directly, and then higher frequency components are quantized and encoded one at a time relative to their nearest lower-frequency neighbor. While this approach is simple, it may not be optimal. For example, in some frames it may be more efficient to relax the nearest-neighbor constraint.

In arriving at the present invention, the inventors have sought to derive a more general method for FD encoding of sinusoidal model parameters. For given parameter quantizers and code-word lengths (in bits) corresponding to each quantization level, the proposed method finds the optimal combination of frequency differential and direct encoding of the sinusoidal components in a frame. The method is more general than existing schemes in the sense that it allows for parameter differences involving any component pair, that is to say, not necessarily frequency domain neighbors. Furthermore, unlike the simple scheme described above, several (in the extreme case, all) components may be encoded directly, if this turns out to be most efficient.

From a method of coding an audio signal, the method being characterised by a step of encoding parameters of a given sinusoidal component in encoded frames either differentially relative to other components in the same frame or directly, i.e. without differential encoding.

From various further aspects, the invention provides methods and apparatus set forth in the independent claims below. Further preferred features of embodiments of the invention are set forth in the dependent claims below.

Embodiments of the invention will now be described in detail, by way of example, and with reference to the accompanying drawings, in which.

Figure 3A:
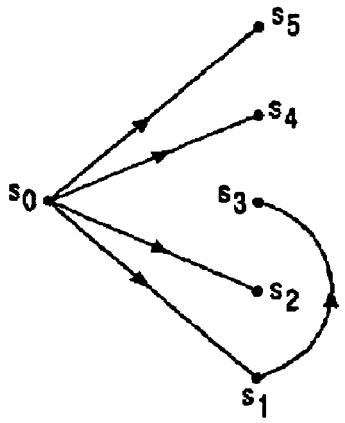
Figure 3B:
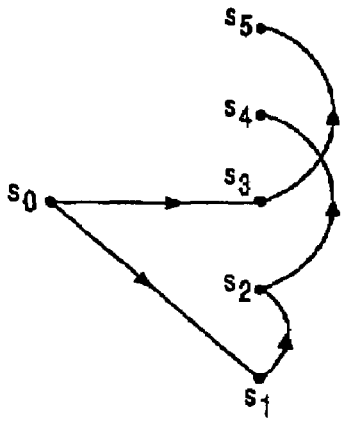
Figure 4:
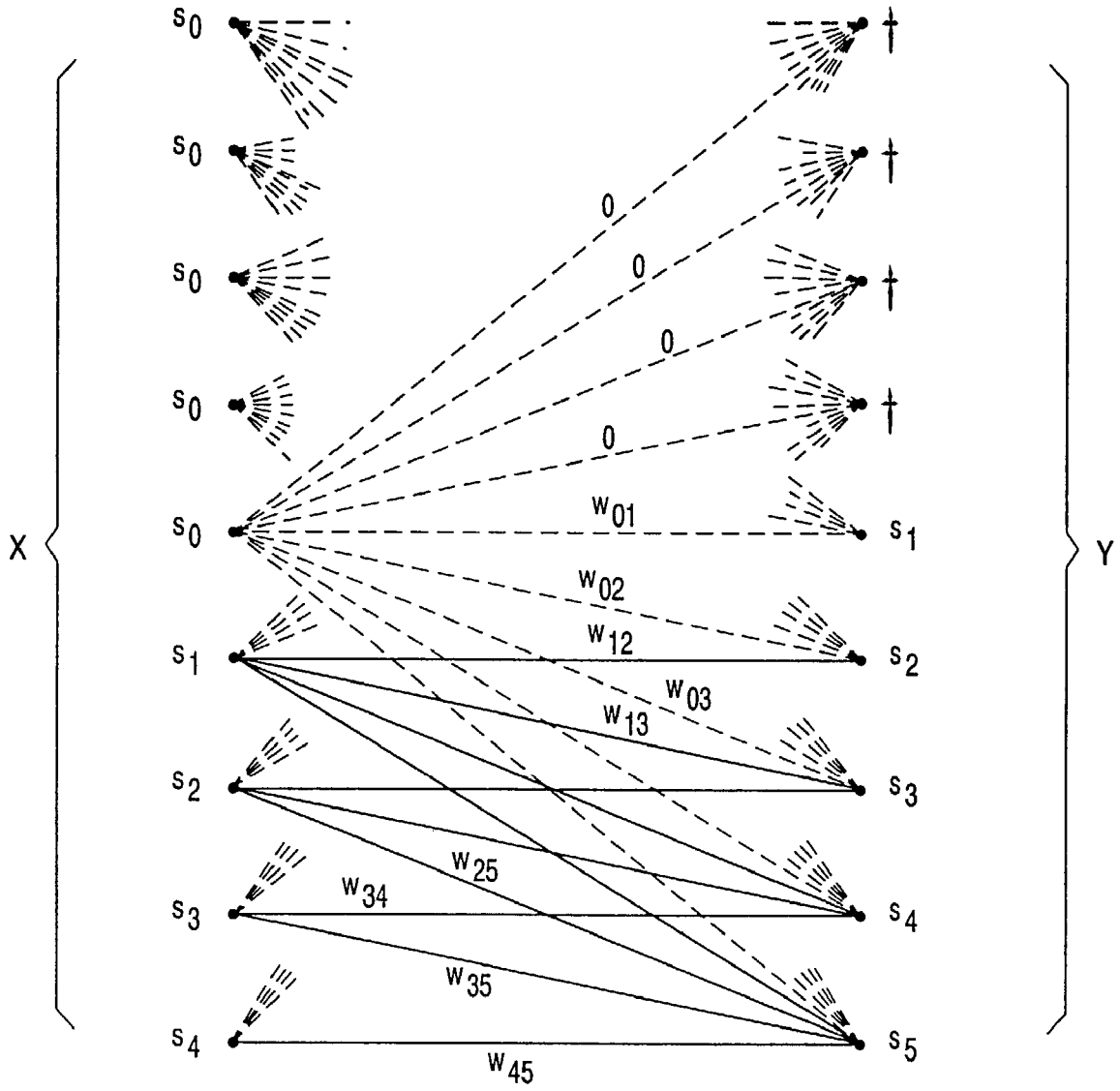
Figure 6C:
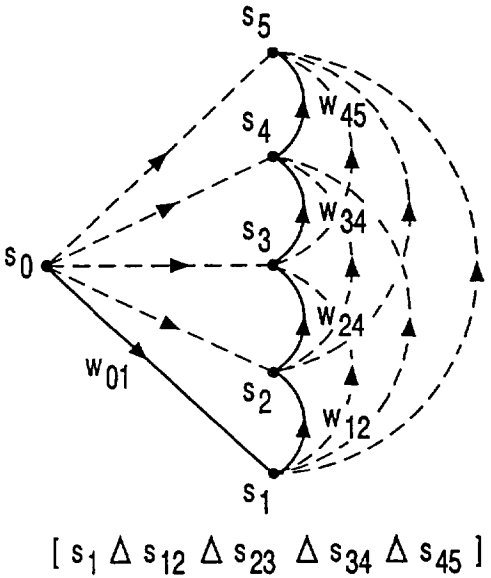
Figure 6B:
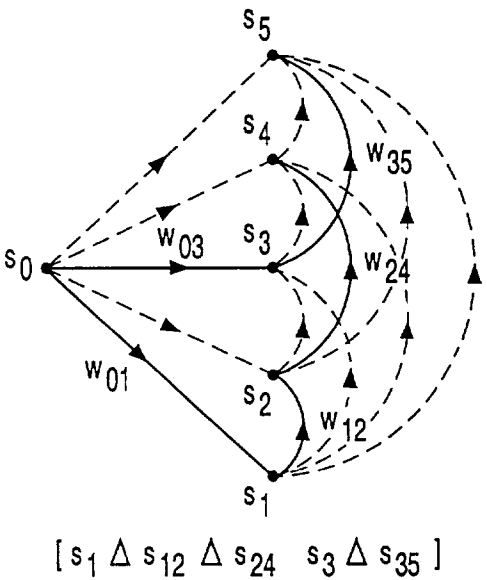
Figure 6A:
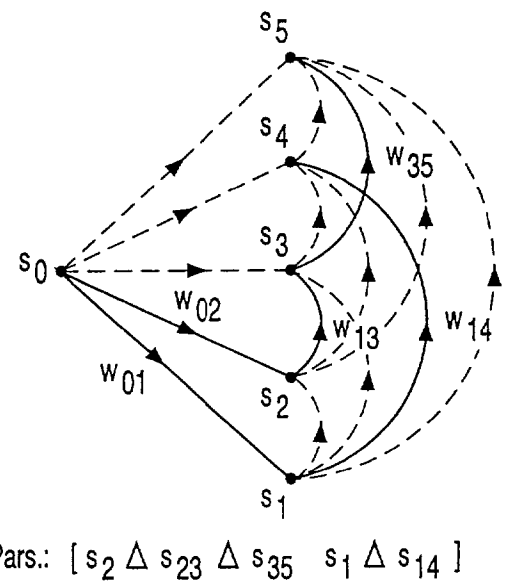
Figure 7:
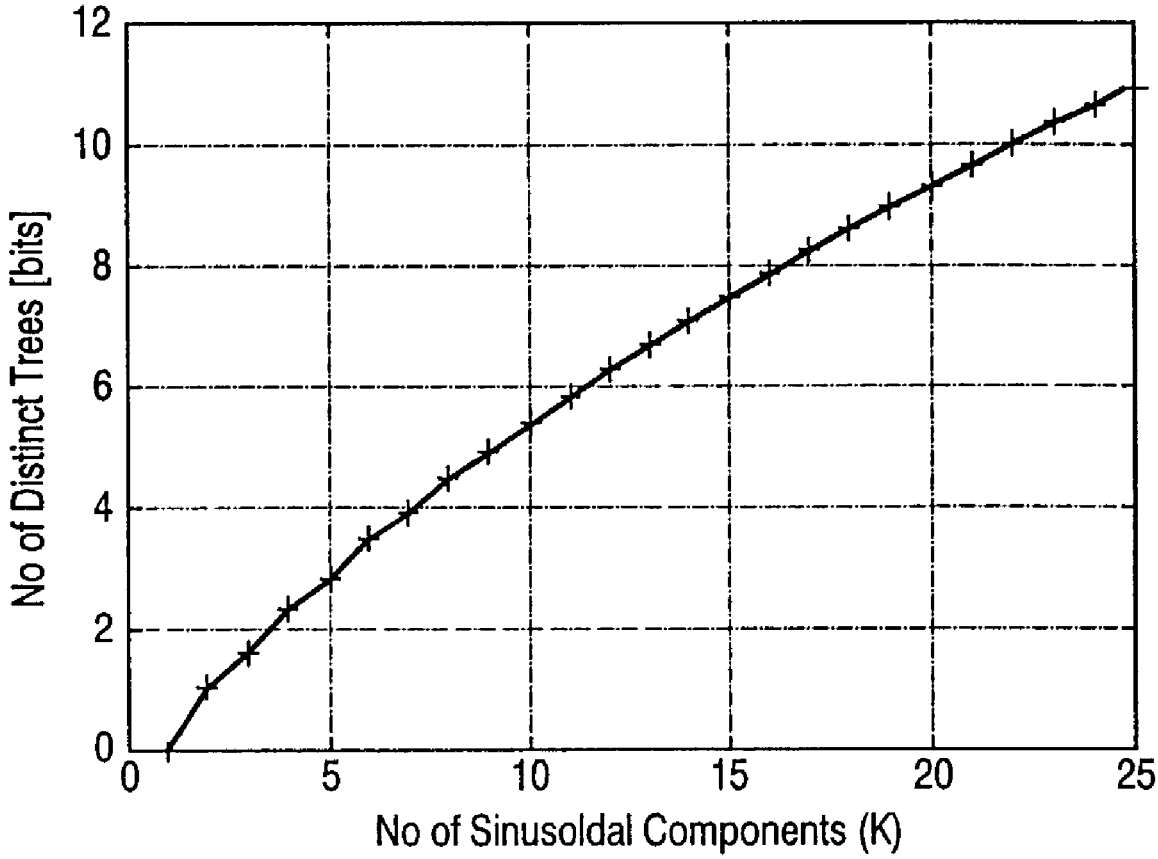
Figure 8:
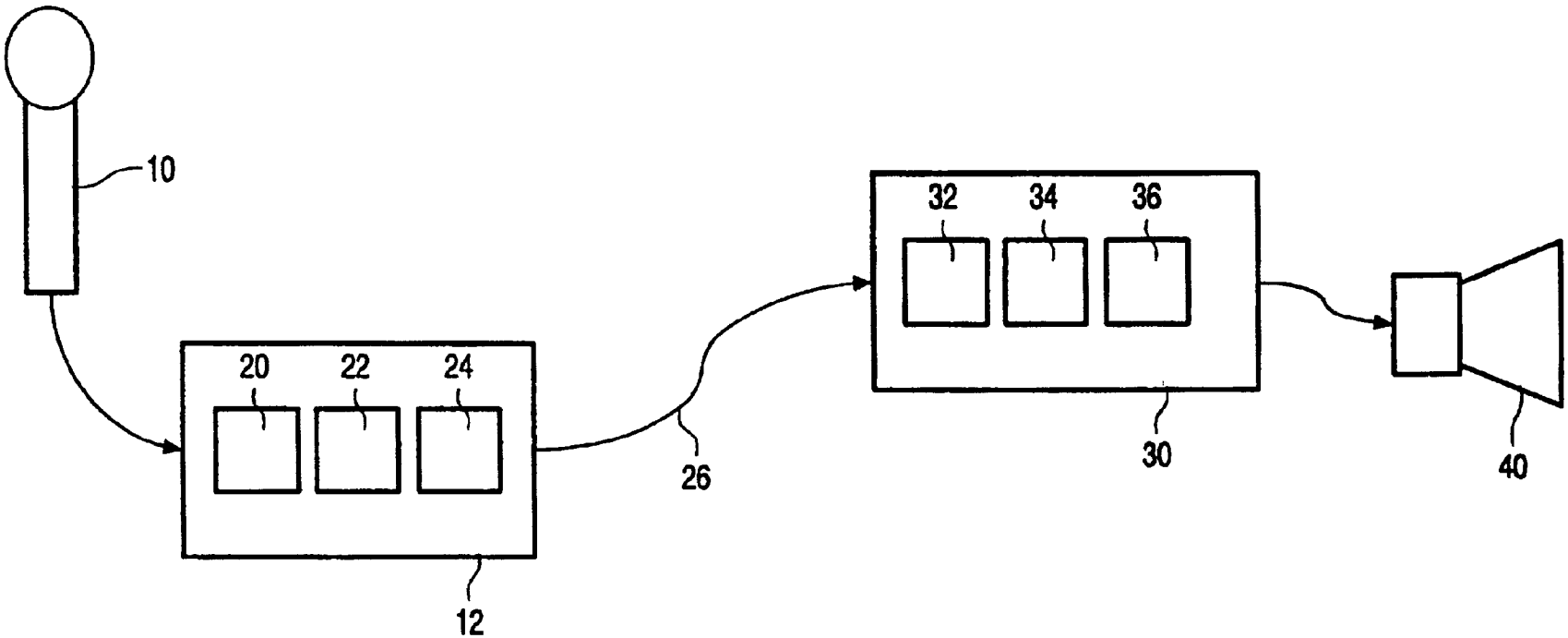

FIG. 3 shown examples of allowed solution trees for the K=5 case;

FIG. 4 shows a graph G (K=5) for representing possible solutions of Problem 1 (as defined below) as assignments, wherein, for clarity, only a few of the edges and weights are shown;

FIG. 5 shows assignments in graph G corresponding to the trees in FIG. 3;

FIGS. 6*a* to 6*c* show examples of topologically identical and distinct solution trees;

FIG. 7 is a graph of the number of topologically distinct solution trees in an encoded signal embodying the invention as a function of the number of sinusoidal components K; and FIG. 8 is a simplified block diagram of a system for transmitting audio data embodying the invention.

Embodiments of the invention can be constituted in a system for transmitting audio signals over an unreliable communication link, such as the Internet. Such a system, shown diagrammatically in FIG. 8, typically comprises a source of audio signals 10, and transmitting apparatus 12 for transmitting audio signals from the source 10. The transmitting apparatus 12 includes an input unit 20 for obtaining an audio signal from the source 10, an encoding device 22 for coding the audio signal to obtain the encoded audio signal, and an output unit 24 for transmitting or recording the encoded audio signal by applying the encoded signal to a network link 26. Receiving apparatus 30 connected to the network link 26 to receive the encoded audio signal. The receiving apparatus 30 includes an input unit 32 for receiving the encoded audio signal, a device 34 for decoding the encoded audio signal to obtain a decoded audio signal, and an output unit 36 for outputting the decoded audio signal. The output signal can then be reproduced, recorded or otherwise processed as required by suitable apparatus 40.

Within the encoding device 22, the signal is encoded in accordance with a coding method comprising a step of encoding parameters of a given sinusoidal component either differentially relative to other components in the same frame or directly, i.e. without differential encoding. The method must determine whether or not to use differential coding at any stage in the encoding process.

In order to formulate the problem that must be solved by the method to arrive at this determination, consider the situation where a number of sinusoidal components $s_1, \ldots, s_K$ have been estimated in a signal frame. Each component $s_k$ is described by an amplitude $a_k$ and a frequency value $\omega_k$. For the purposes of the present description it is not necessary to consider phase values since these may be derived from the frequency parameters or quantized directly. Nonetheless, it will be seen that the invention may in fact be extended to phase values and/or other values such as damping coefficients.

Consider the following possibilities for quantization of the parameters of a given component:

1) Direct quantization (i.e., non-differential), or
2) Differential quantization relative to the quantized parameters of one the components at lower frequencies.

Figure 1:
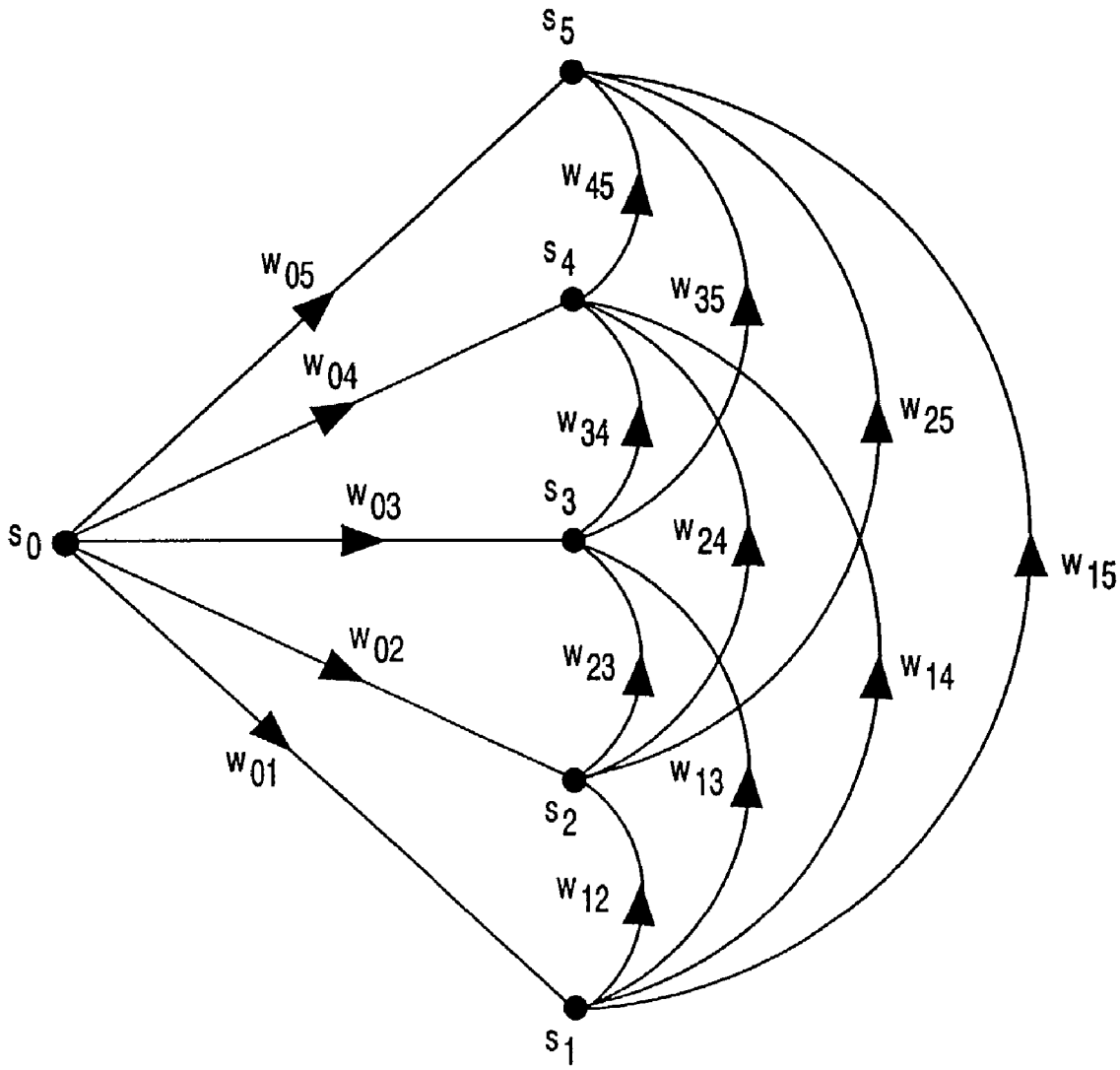
FIG. 1 is a directed graph D used for representing all possible combinations of direct and frequency-differential encoding of the sinusoidal components (K=5) in a given frame.

The set of all possible combinations of direct and differential quantization is represented using a directed graph (digraph) D as illustrated in FIG. 1.

The vertices $s_1, \ldots, s_K$ represent the sinusoidal components to be quantized. Edges between these vertices represent the possibilities for differential encoding, e.g., the edge between $s_1$ and $s_4$ represents quantization of the parameters of $s_4$ relative to $s_1$ (that is, $\hat{a}_4=\hat{a}_1+\Delta\hat{a}_{14}$ for amplitude parameters). The vertex $s_0$ is a dummy vertex introduced to represent the possibility of direct quantization. For example, the edge between $s_0$ and $s_2$ represents direct quantization of the parameters of $s_2$. Each edge is assigned a weight $w_{ij}$, which corresponds to a cost in terms of rate and distortion of choosing the particular quantization represented by the edge. The basic task is to find a rate-distortion optimal combination of direct and differential encoding. This corresponds to finding the subset of K edges in D with minimum total cost, such that each vertex $s_1, \ldots, s_K$ has exactly one in-edge assigned.

The calculation of edge weights will now be described. In principle, each edge weight is of the form:

$$w_{ij}=r_{ij}+\lambda d_{ij} \qquad \text{Equation 1}$$

where $r_{ij}$ and $d_{ij}$ are the rate (i.e. the numbers of bits) and the distortion, respectively, associated with this particular quantization, and $\lambda$ is a Lagrange multiplier. Generally, since higher-indexed components $s_j$ are quantized relative to (already quantized) lower-indexed components as shown in FIG. 1, the exact value of a weight $w_{ij}$ depends on the particular quantization of the lower-indexed component $s_i$. In other words, the value of $w_{ij}$ cannot be calculated before $s_i$ has been quantized. To eliminate this dependency, we assume that similar quantizers are used for direct and differential quantization as illustrated in FIG. 2 for amplitude parameters.

Figure 2:
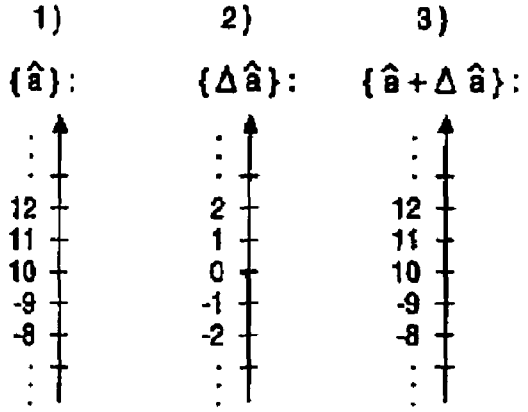
FIG. 2 shows an example of output levels for scalar amplitude quantizers in an embodiment of the invention.

In FIG. 2, column 1 lists output levels for direct amplitude quantizers, column 2 lists output levels for differential amplitude quantizers, and column 3 lists the set of reachable amplitude levels after differential quantization.

With this assumption, the quantizer levels that can be reached through direct and differential quantization are identical, and a given component will be quantized in the same way, independent of whether direct or differential quantization is used. This in turn means that the total distortion is constant for any combination of direct and differential encoding, and we can set $\lambda=0$ in equation 1. Furthermore, now all weight values of D can be calculated in advance as $w_{ij}=r_{ij}$, where $$r_{ij}=\begin{cases} r_{\hat{a}_j}+r_{\hat{\omega}_j} \text{ for } i=0,\ j=1,\ \ldots,\ K \\ r_{\Delta\hat{a}_{ij}}+r_{\Delta\hat{\omega}_{ij}},\ i=1,\ \ldots,\ K-1,\ j=i+1,\ \ldots,\ K \end{cases}$$

and the integer $r_{(\cdot)}$ denotes the number of bits needed to represent the quantized parameter $(\cdot)$. In this example, the values of $r_{(\cdot)}$ are found as entries in pre-calculated Huffman code-word tables.

In order to clearly understand the example, it is necessary to formulate the problem that is being addressed. Assuming that the signal frame in question contains K sinusoidal components to be encoded, we formulate the optimal FD encoding problem as follows:

Problem 1: For a given digraph D with edge weights $w_{ij}$, find the set of K edges with minimum total weight such that:

a) each vertex $s_1, \ldots, s_K$ is assigned exactly one in-edge, and
b) each vertex $s_1, \ldots, s_K$ is assigned a maximum of one out-edge.

Figure 3C:
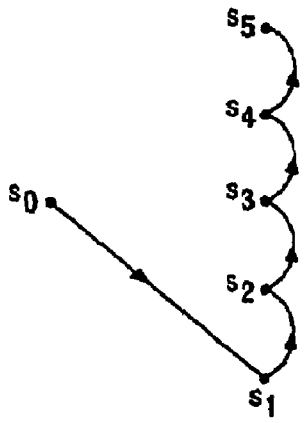

Constraint a) is essential since it ensures that each of the K sinusoidal components is quantized and encoded exactly once. Constraint b) enforces a particular simple structure on the K edge solution tree. This is of importance for reducing the amount of side information needed to tell the decoder how to combine the transmitted (delta-) amplitudes and frequencies. FIG. 3 shows examples of possible solution trees satisfying constraints a) and b). Note that the 'standard' FD encoding configuration used in e.g. some prior art proposals is a special case in FIG. 3*c* of the presented framework.

In solving the above problem, two algorithms (referred to as Algorithm 1 and Algorithm 2) are provided. Algorithm 1 is mathematically optimal, while Algorithm 2 provides an approximate solution at a lower computational cost.

Algorithm 1: In order to solve Problem 1, we reformulate it as a so-called assignment problem, which is a well-known problem in graph-theory. Using the digraph D (FIG. 1), we construct a graph G as shown in FIG. 4. The vertices of G can be divided into two subsets: the subset X on the left-hand side, which contains the vertices $s_1, \ldots, s_{K-1}$ and K copies of $s_0$, and the subset Y on the right-hand side, which contains the vertices $s_1, \ldots, s_K$ and K−1 dummy vertices, shown as †.

A number of edges connect the vertices of X and Y. Edges connected to vertices in X correspond to out-edges in the digraph D, while edges connected to vertices $s_1, \ldots, s_K \epsilon Y$ correspond to in-edges in D. For example, the edge from $s_2 \epsilon X$ to $s_4 \epsilon Y$ in G corresponds to the edge $s_2 s_4$ in the digraph D. Thus, the solid line edges in graph G represent the 'differential encoding' edges in digraph D. Furthermore, the dashed-line edges from the vertices $\{s_0\} \epsilon X$ to $s_1, \ldots, s_K \epsilon Y$ all correspond to direct encoding of components $s_1, \ldots, s_K$. The weights of the edges connecting vertices in X with vertices $s_1, \ldots, s_K \epsilon Y$ are identical to the weights of the corresponding edges in digraph D. Finally, the K−1 dummy vertices $\{\dagger\} \epsilon Y$ are used to represent the fact that some vertices in the solution trees may be 'leaves', i.e., do not have any out-edges. For example, in FIG. 3*a*, vertex $s_2$ is a leaf. In the graph G, this is represented as an edge from $s_2 \epsilon X$ to one of the vertices $\dagger \epsilon Y$. All edges connected to †-vertices have a weight of 0.

Figure 5C:
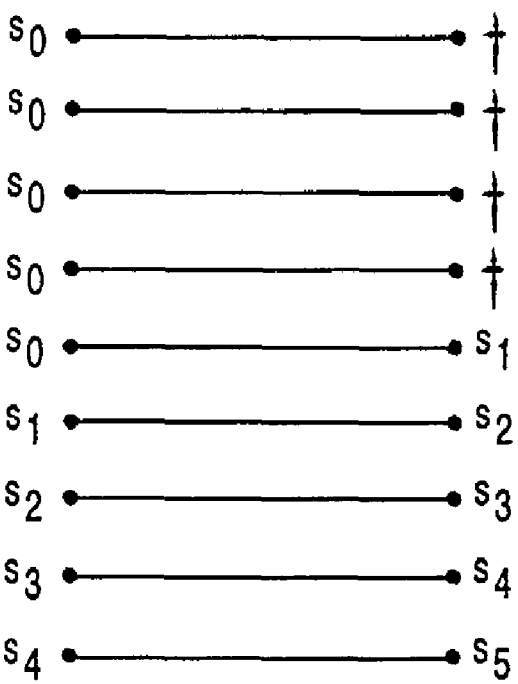
Figure 5B:
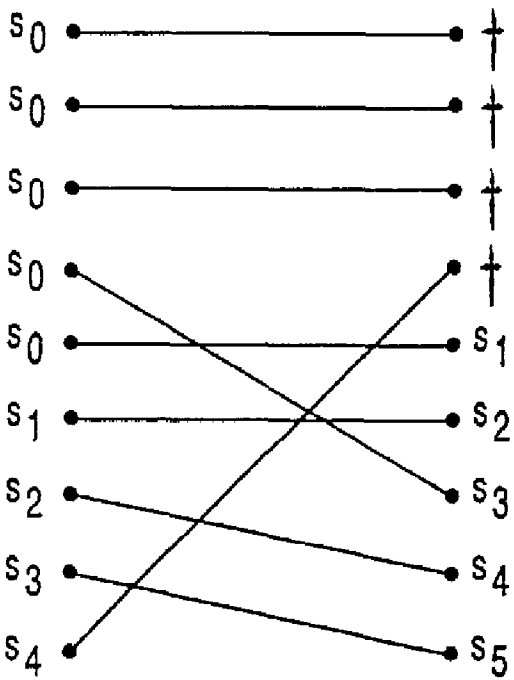
Figure 5A:
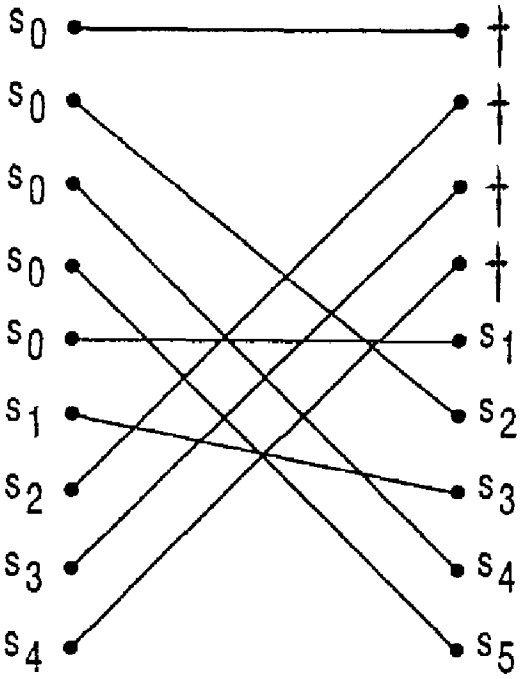

It can be shown that each set of K edges in D that satisfies constraints a) and b) of Problem 1, can be represented as an assignment in G of the vertices in X to the vertices in Y, i.e., a subset of 2K−1 edges in G such that each vertex is assigned exactly one edge. FIGS. 5*a-c* show examples of assignments corresponding to the trees in FIGS. 3*a-c,* respectively. Thus, Problem 1 can be reformulated as the so-called Assignment Problem, which we will refer to as Problem 2.

Problem 2: Find in graph G the set of 2K−1 edges with minimum total weight such that each vertex is assigned exactly one edge.

Several algorithms exist for solving Problem 2, such as the so-called Hungarian Method, as discussed in H. W. Kuhn, "*The Hungarian Method for the Assignment Problem*", Naval Research Logistics Quarterly, 2:83-97, 1955 which solves the problem in $O((2K-1)^3)$ arithmetic operations. An alternative implementation is an algorithm described in R. Jonker and A. Volgenant, "A Shortest Augmenting Path Algorithm for Dense and Sparse Linear Assignment Problems", Computing, vol.38, pp.325-340, 1987. The complexity is similar to the Hungarian Method, but the Jonker and Volgenants algorithm is faster in practice. Further, their algorithm can solve sparse problems faster, which is of importance for the multi-frame linking algorithm of this embodiment.

In summary, Algorithm 1 consists of the following steps. First, the digraph D (and as a result the graph G) is constructed. Then, the assignment in G with minimal weight (Problem 2) is determined. Finally, from the assignment in G, the optimal combination of direct and differential coding is easily derived.

Algorithm 2 is an iterative, greedy algorithm that treats the vertices $s_1, \ldots, s_K$ of the graph D one at a time for increasing indices. At iteration k, one of the in-edges of vertex $s_k$ is selected from a candidate edge set. The candidate set consists of the in-edges of $s_k$ originating from vertices with no previously selected out-edge, and the direct encoding edge $s_0 s_k$. From this set, the edge with minimal weight is selected. With this procedure, a set of K edges is obtained that satisfies constraints a) and b) of Problem 1. Generally, this greedy approach is not optimal, i.e., there may exist another set of K edges with a lower total weight satisfying constraints a) and b). Algorithm 2 has a computational complexity of $O(K^2)$.

In addition to the sinusoidal (delta-) parameters encoded as described above, an encoded signal embodying the invention must include side information that describes how to combine the parameters at the decoder. One possibility is to assign to each possible solution tree one symbol in the side information alphabet. However, the number of different solution trees is large; for example with K=25 sinusoidal components in a frame, it can be shown that the number of different solution trees is approximately $10^{18}$, corresponding to 62 bits for indexing the solution tree in the side information alphabet. Clearly, this number is excessive for most applications. Fortunately, the side information alphabet only needs to represent topologically distinct solution trees, provided that a particular ordering is applied to the (delta-) parameter sequence. To clarify the notion of topologically distinct trees and parameter ordering, consider the examples of solution trees in FIGS. 6*a* to 6*c,* and the corresponding parameter sequences listed below the trees. The spanning trees in FIGS. 6*a* and 6*b* are topologically identical, since they each consist of a three-edge and a two-edge branch, and would thus be represented with the same symbol in the side information alphabet. Conversely, the tree in FIG. 6*c,* which consists of a single five-edge branch, is topologically distinct from the others. Knowing the topological tree structure and assuming for example that the (delta-) parameters occur branch-wise in the parameter stream with longest branches first, it is possible for the decoder to combine the received parameters correctly.

Consequently, preferred embodiments of the invention provide a side information alphabet whose symbols correspond to topologically distinct solution trees. An upper bound for the side information is given by the number of such trees. There follows expressions for the number of topological distinct trees.

As illustrated in the examples of FIG. 6*a* to 6*c,* the structure of the solution trees can be represented by specifying the length of each branch in the tree. Assuming a longest-branches-first ordering, the set of topologically distinct trees is specified by distinct sequences of non-increasing positive integers whose sum is K; in combinatorics, such sequences are referred to as "integer partitions" of the positive integer K. For example, for K=5, there exist the following seven integer partitions: {5} (FIG. 1*c*), {4,1}, {3,2} (FIGS. 1*a* and 1*b*), {3,1,1}, {2,2,1}, {2,1,1,1}, and {1,1,1,1,1}. Thus, for K=5, there are seven topologically distinct solution trees, and the side information alphabet would consist of seven symbols. Letting $P_j(K)$ denote the number of integer partitions of K whose first integer is j, it is straight-forward to show that the number P of distinct solution trees is given by the following recursions:

$$P(K) = \sum_{i=1}^{K} P_i(K) \qquad \text{Equation 2}$$

where $$P_j(K) = \begin{cases} \sum_{k=1}^{\min(K-j,j)} P_k(K-j), & j = 1, \ldots, K-1 \\ 1, & j = K \end{cases} \qquad \text{Equation 3}$$

FIG. 7 shows the number of topologically distinct trees as a function of the number K of sinusoidal components. Thus, indexing of the side information alphabet for K=25 would require a maximum of 11 bits. Note that the graph represents an upper bound for the side information; exploiting statistical properties using e.g. entropy coding may reduce the side information rate further.

The performance of the proposed algorithms can be demonstrated in a simulation study with audio signals. Four different audio signals sampled at a rate of 44.1 kHz and with a duration of approximately 20 seconds each were divided into frames of a fixed length of 1024 samples using a Hanning window with a 50% overlap between consecutive frames.

Each signal frame was represented using a sinusoidal model with a fixed number of K=25 constant-amplitude, constant-frequency sinusoidal components, whose parameters were extracted using a matching pursuit algorithm. Amplitude and frequency parameters were quantized uniformly in the log-domain using relative quantizer level spacings of 20% and 0.5%, respectively. Similar relative quantization levels were used for direct and differential quantization, as shown in FIG. 2, and quantized parameters were encoded using Huffman coding.

Experiments were conducted where Algorithms 1 and 2 were used to determine how to combine direct and FD encoding for each frame. In addition, simulations were run where amplitude and frequency parameters were quantized using the 'standard' FD encoding configuration illustrated in FIG. 3*c* for K=5. Finally, to determine the possible gain of FD encoding, parameters were quantized directly, i.e., without differential encoding. Each experiment used different Huffman codes estimated within the experiment.

For each of these encoding procedures, the bit rate $R_{pars}$, needed for encoding of (delta-) amplitudes and frequencies was estimated (using first-order entropies). Furthermore, since Algorithms 1 and 2 require that information about the solution tree structure be sent to the decoder, the bit rate $R_{S.I}$: needed for representing this side information was estimated as well. Table 1 below shows the estimated bit rates for the various coding strategies and test signals. In this context, comparison of bit rates is reasonable because similar quantizers are used for all experiments, and, consequently, the test signals are encoded at the same distortion level.

The columns in Table 1 below show bit rates [kbps] for various coding schemes and test signals. The table columns are $R_{Pars}$: bit rate for representing (delta-) amplitudes and frequencies, $R_{S.I}$: rate needed for side information (tree structures), and $R_{Total}$: total rate. Gain is the relative improvement with various FD encoding schemes over direct encoding (non-differential).

Table 1 shows that using Algorithm 1 for determining the combination of direct and FD encoding gives a bit-rate reduction in the range of 18.8-27.0% relative to direct encoding. Algorithm 2 performs nearly as well with bit-rate reductions in the range of 18.5-26.7%. The slightly lower side information resulting from Algorithm 2 is due to the fact that Algorithm 2 tends to produce solution trees with fewer but longer 'branches', thereby reducing the number of different solution trees observed. Finally, the 'standard' method of FD encoding reduces the bit rate with 12.7-24.0%.

Therefore, encoding methods are provided that use two algorithms for determining the bit-rate optimal combination of direct and FD encoding of sinusoidal components in a given frame. In simulation experiments with audio signals, the presented algorithms showed bit-rate reductions of up to 27% relative to direct encoding. Furthermore, the proposed methods reduced the bit rate with up to 7% compared to a typically used FD encoding scheme. While consideration of the invention has been focused on FD encoding as a stand-alone technique, in further embodiments the scheme is generalizes to describe FD encoding in combination with TD encoding. With such joint TD/FD encoding schemes, it is possible to provide embodiments that combine the strengths of the two encoding techniques.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word 'comprising' does not exclude the presence of other elements or steps than those listed in a claim. The invention can be implemented by means of hardware comprising several distinct elements, and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

TABLE 1

| | $R_{Pars.}$ | $R_{S.I}$ | $R_{Total}$ | Gain |
|---|---|---|---|---|
| Signal 1 | | | | |
| Direct | 29.1 | 0 | 29.1 | — |
| Alg. 1 | 20.8 | 0.6 | 21.4 | 26.5% |
| Alg. 2 | 20.9 | 0.5 | 21.5 | 26.1% |
| Standard | 22.3 | 0 | 22.3 | 23.4% |
| Signal 2 | | | | |
| Direct | 27.6 | 0 | 27.6 | — |
| Alg. 1 | 21.6 | 0.7 | 22.4 | 18.8% |
| Alg. 2 | 21.8 | 0.7 | 22.5 | 18.5% |
| Standard | 24.1 | 0 | 24.1 | 12.7% |
| Signal 3 | | | | |
| Direct | 30.0 | 0 | 30.0 | — |
| Alg. 1 | 21.2 | 0.7 | 21.9 | 27.0% |
| Alg. 2 | 21.4 | 0.6 | 22.0 | 26.7% |
| Standard | 22.8 | 0 | 22 8 | 24.0% |
| Signal 4 | | | | |
| Direct | 28.6 | 0 | 28.6 | — |
| Alg. 1 | 21.5 | 0.7 | 22.2 | 22.4% |
| Alg. 2 | 21.8 | 0.7 | 22.5 | 21.3% |
| Standard | 22.9 | 0 | 22.9 | 19.9% |

The invention claimed is:

1. A method comprising:

determining a parameter of a sinusoidal component in a frame of an audio signal, selectively encoding the parameter either differentially relative to other components in the frame, or directly.

2. The method of claim 1, including algorithmically deciding whether a parameter is encoded differentially or directly.

3. The method of claim 2, wherein selectively encoding the parameter includes an optimal determination as to whether the parameter is encoded differentially or directly based on an estimated encoding size of the frame.

4. The method of claim 3, including:

constructing a digraph D of the set of all possible combinations of direct and differential quantized components;

constructing a graph G based on the digraph D;

determining an assignment in 0 with minimal total weight; and deriving the optimal combination of direct and differential coding from the assignment in G.

5. The method of claim 4, including finding an optimal combination in graph G of a set of 2K−1 edges with minimum total weight such that each vertex is assigned exactly one edge.

6. The method of claim 5, wherein finding the optimal combination includes use of the Hungarian Method for solving an assignment problem.

7. The method of claim 5, wherein finding the optimal combination includes use of a shortest augmenting path algorithm for solving an assignment problem.

8. The method of claim 2, wherein selectively encoding the parameter includes an approximate determination as to whether a parameter is encoded differentially or directly based on an estimated encoding size of the frame.

9. The method of claim 8, including applying an iterative, greedy algorithm.

10. The method of claim 9, including:

constructing a digraph D of the set of all possible combinations of direct and differential quantized components;

treating the vertices $s_1, \ldots, s_K$ of the graph D one at a time for increasing indices;

selecting an in-edge of vertex $s_k$ from a candidate edge set, the candidate edge set comprising in-edges of $s_k$ originating from vertices with no previously selected out-edge, and a direct encoding edge $s_0 s_k$; and selecting from this set, the edge with minimal weight.

11. The method of claim 1, including generating side information that specifies whether each parameter of components in the frame is encoded differentially or directly.

12. A method of decoding an encoded audio signal in which the signal has been encoded in accordance with the method of claim 1.

13. A device comprising:

an encoder that is configured to:

receive an audio signal, and encode parameters of sinusoidal components of a frame of the audio signal, wherein the parameters are selectively encoded either differentially relative to parameters of other components in the frame or directly to form an encoded audio signal.

14. The device of claim 13, including:

an input unit for obtaining the audio signal, and an output unit for transmitting or recording the encoded audio signal.

15. A method comprising:

decoding an encoded audio signal to extract parameters of sinusoidal components of an audio signal corresponding to the encoded audio signal, reconstructing the audio signal based on whether each parameter has been encoded in encoded frames of the encoded audio signal either differentially relative to other components in a same frame or directly.

16. The method of claim 15, wherein side information in the encoded audio signal is used to determine whether a parameter of a component in the frame has been encoded differentially or directly.

17. A device comprising:

a decoder that is configured to:

receive an encoded audio signal, decode parameters of sinusoidal components in encoded frames of the encoded audio signal, and reconstruct a decoded audio signal corresponding to the encoded audio signal based on whether each parameter is encoded differentially relative to other components in the same frame or directly.

18. The device of claim 17, wherein the decoder is configured to determine whether a component in a frame is to be decoded differentially or directly based on side information in the encoded audio signal.

19. The device of claim 17, including:

an input unit for receiving the encoded audio signal, and an output unit for outputting the decoded audio signal.

20. An encoded audio signal that comprises parameters of a given sinusoidal component that have been encoded in encoded frames either differentially relative to other components in the same frame or directly.

21. The encoded audio signal of claim 20, including side information that specifies whether components in a frame are encoded differentially or directly.

22. A storage medium on which an encoded audio signal as claimed in claim 20 has been stored.

* * * * *